US009358604B2

(12) United States Patent
Jentzsch et al.

(10) Patent No.: US 9,358,604 B2
(45) Date of Patent: Jun. 7, 2016

(54) SYSTEM FOR COMPRESSION RELIEF SHAPING

(71) Applicant: Ball Corporation, Broomfield, CO (US)

(72) Inventors: Kevin R. Jentzsch, Arvada, CO (US); John R. Ross, Westminster, CO (US); Matthias K. van de Liefvoort, Louisville, CO (US); Mark A. Jacober, Arvada, CO (US)

(73) Assignee: Ball Corporation, Broomfield, CO (US)

( * ) Notice: Subject to any disclaimer, the term of this patent is extended or adjusted under 35 U.S.C. 154(b) by 184 days.

(21) Appl. No.: 14/303,191

(22) Filed: Jun. 12, 2014

(65) Prior Publication Data

US 2015/0360279 A1 Dec. 17, 2015

(51) Int. Cl.

| | |
|---|---|
| ***B21D 51/26*** | (2006.01) |
| ***B21D 51/24*** | (2006.01) |
| ***B21D 31/00*** | (2006.01) |
| ***B21D 41/00*** | (2006.01) |
| ***B21D 26/041*** | (2011.01) |
| ***B21D 26/033*** | (2011.01) |
| ***B21D 26/049*** | (2011.01) |

(52) U.S. Cl.

CPC ..... *B21D 51/24* (2013.01); *B21D 26/033* (2013.01); *B21D 26/041* (2013.01); *B21D 26/049* (2013.01); *B21D 31/00* (2013.01); *B21D 41/00* (2013.01)

(58) Field of Classification Search

CPC .. B21D 26/049; B21D 26/033; B21D 26/041; B21D 31/00; B21D 41/00; B21D 51/24

See application file for complete search history.

(56) References Cited

U.S. PATENT DOCUMENTS

| | | | | |
|---|---|---|---|---|
| 463,575 | A | 11/1891 | McCoy | |
| 509,525 | A | 11/1893 | Gray | |
| 2,442,841 | A | 6/1948 | Catlin et al. | |
| 3,771,476 | A | 11/1973 | Heinle | |
| 3,837,213 | A * | 9/1974 | Guzzo | B21D 41/00 72/479 |
| 3,896,648 | A * | 7/1975 | Schertenleib | B21D 26/041 29/421.1 |
| 3,995,572 | A | 12/1976 | Saunders | |
| 3,998,174 | A | 12/1976 | Saunders | |
| 4,481,163 | A | 11/1984 | Ota et al. | |
| 5,355,710 | A | 10/1994 | Diekhoff | |
| 5,448,903 | A | 9/1995 | Johnson | |
| 5,469,729 | A | 11/1995 | Hager | |
| 5,555,992 | A | 9/1996 | Sedgeley | |

(Continued)

FOREIGN PATENT DOCUMENTS

| | | |
|---|---|---|
| EP | 0786295 | 7/1997 |
| EP | 1531952 | 8/2006 |

(Continued)

OTHER PUBLICATIONS

International Search Report and Written Opinion for International (PCT) Patent Application No. PCT/US15/34379, mailed Sep. 2, 2015 6 pages.

*Primary Examiner* — David B Jones

(74) *Attorney, Agent, or Firm* — Sheridan Ross P.C.

(57) ABSTRACT

Methods and apparatus for reshaping a shoulder and/or neck portion of a metallic container are provided. A shoulder shaping or reshaping tool comprises a generally annular device with relief features provided on an internal surface. The tool is adapted to engage the exterior surface of a container to be shaped to provide outwardly extending ornamental features.

9 Claims, 7 Drawing Sheets

(56) References Cited

U.S. PATENT DOCUMENTS

| | | | | |
|---|---|---|---|---|
| 5,557,963 | A | 9/1996 | Diekhoff | |
| 5,572,893 | A | 11/1996 | Goda et al. | |
| 5,713,235 | A | 2/1998 | Diekhoff | |
| 5,718,352 | A | 2/1998 | Diekhoff et al. | |
| 5,775,161 | A | 7/1998 | Caleffi et al. | |
| 5,782,375 | A | 7/1998 | McHenry et al. | |
| 5,829,290 | A * | 11/1998 | Harvey | B21D 26/033 72/58 |
| 5,832,766 | A * | 11/1998 | Hartman | B21D 51/2646 72/58 |
| 6,094,961 | A | 8/2000 | Aschberger | |
| 6,095,378 | A | 8/2000 | Potts et al. | |
| 6,250,122 | B1 * | 6/2001 | Robinson | B21D 26/049 29/421.1 |
| 6,286,357 | B1 | 9/2001 | D'Amore et al. | |
| 6,484,550 | B2 | 11/2002 | Halasz et al. | |
| 6,499,329 | B1 | 12/2002 | Enoki et al. | |
| 6,857,304 | B2 | 2/2005 | Enoki | |
| 7,140,223 | B2 | 11/2006 | Chupak | |
| 7,726,165 | B2 * | 6/2010 | Myers | B21D 51/2638 72/348 |
| 7,934,410 | B2 | 5/2011 | Myers et al. | |
| 7,954,354 | B2 | 6/2011 | Myers et al. | |
| 8,899,085 | B2 * | 12/2014 | Adams | B21D 26/049 72/370.22 |
| 2009/0193866 | A1 | 8/2009 | Hamstra | |
| 2010/0107718 | A1 | 5/2010 | Kang | |
| 2010/0107719 | A1 | 5/2010 | Geho | |
| 2010/0199741 | A1 | 8/2010 | Myers et al. | |
| 2011/0167889 | A1 | 7/2011 | Myers et al. | |

FOREIGN PATENT DOCUMENTS

| | | |
|---|---|---|
| GB | 1472860 | 5/1977 |
| JP | S61-193729 | 8/1986 |
| JP | S63-224835 | 9/1988 |
| JP | H04-157031 | 5/1992 |
| JP | H05-212478 | 8/1993 |
| JP | H06-238379 | 8/1994 |
| JP | H07-155869 | 6/1995 |
| JP | H08-71673 | 3/1996 |
| JP | H09-19732 | 1/1997 |
| JP | H09-168834 | 6/1997 |
| JP | H10-235442 | 9/1998 |
| JP | 2003-320431 | 11/2003 |
| JP | 2005-219804 | 8/2005 |
| JP | 2005-313924 | 11/2005 |
| JP | 2006-159224 | 6/2006 |
| JP | 2006-247659 | 9/2006 |
| JP | 2008-132522 | 6/2008 |
| WO | WO 99/32242 | 7/1999 |
| WO | WO 2010/048726 | 5/2010 |
| WO | WO 2011/053776 | 5/2011 |

* cited by examiner

SYSTEM FOR COMPRESSION RELIEF SHAPING

FIELD OF THE INVENTION

The present invention relates to a compression relief apparatus for applying shaped or textured features to the neck or shoulder region of a metal container. More specifically, the present invention contemplates an apparatus and method for forming predetermined shapes into the shoulder or neck of drawn and ironed aluminum bottles and cans.

BACKGROUND OF THE INVENTION

It is generally known in metal container manufacturing processes to provide features on metallic containers such as raised forms and indicia using opposing, offset inside and outside shaped tooling dies. Outer dies frequently comprise inward protrusions, and inner dies comprise outward protruding features. These devices are typically applied to open ended straight wall containers before necking the container. However, these processes generally do not allow for features to be formed in the neck and/or shoulder area, and existing tools and methods of manufacturing fail to provide for large radius shoulders with common necking technology.

Surface features are generally known to be provided on metal containers using opposing, offset inside and outside shape dies, outer dies with inward protrusions, or inner dies with outward protruding features. Such known devices are typically applied to open ended straight wall containers prior to necking the container. Such known processes do not contemplate or allow for features to be provided in a neck or shoulder region of a container, and require more complexity in tool designs which typically cannot be run at commercially required speeds.

Conventional drawn and ironed aluminum and steel containers are drawn into cups, redrawn into a smaller diameter cup and ironed for increased length and to provide closed cylindrical shapes on bottle shaped containers. After coating applications and curing, the opening size is reduced by various necking methods, die necking, or some combination of die necking and spin necking or spin flow necking to be prepared for application of a closure of various styles such as conventional beverage end closures. Ropp (roll on pilfer proof) closures, or bottle crown caps. In the process of creating the necks of such containers, a shoulder is created where the cylindrical wall of the can body meets the neck. Shoulder configurations are generally arcuate in shape with radii in the range from 0.10 inches to about 2.0 inches.

Conventional die necking reduces the diameter of the container by contact of the cut edge of the container with an axi-symmetric forming die which forces the metal inward to effect a slight reduction in the diameter of the opening. A plurality of necking operations are performed to produce the desired opening size depending on the starting diameter and opening size. An axi-symmetric pilot die is generally used with the necking on the inside of the container to control the metal flow and reduce wrinkling. The forming die radii have generally been in the range of 0.10 inches to 0.50 inches for lightweight metal beverage containers. Conventional drawn and ironed metal containers are then finished with a flange to be able to be closed with a container end closure. Metallic bottle shaped containers are typically finished with either a crown curl or a threaded finish which can receive an aluminum or steel closure.

Some shaping and embossing processes to modify the cylindrical shapes are known in the art such as blow molding inside a die, spin flowing forming, and progressive die necking deep into the body of the container followed by expansion operations to create generally axi-symmetric shapes. However, many of these processes are time consuming, expensive, and not conducive to forming unique outward or inwardly shaped geometries in the shoulder or neck region of the bottle shaped container.

SUMMARY OF THE INVENTION

A method and apparatus for reshaping at least one of a shoulder and a neck of a container is provided. In one embodiment, a method of reshaping a shoulder of a container is provided wherein a bottle shaped container is provided and reshaped or altered to modify either the shape or dimension of the shoulder/neck region. A further step of the method comprises forming one or more raised surface features. This process provides for better control of feature relief forming and reduces "puckling", and other irregularities in the surface features as will be described herein.

Embodiments of the present invention contemplate reshaping bottle shaped metal containers to provide either concentric or non-concentric shapes onto the neck, shoulder and wall portion of the container by use of one or more tools which have unique relief features which allow the metal to flow into recessed portions of the die when a compressive force is applied to the bottle shaped containers. Embodiments of the present invention may apply to impact extruded aerosol containers, and drawn and ironed cans and drawn and ironed metal bottles made from aluminum or steel.

Adding ornamental features to the shoulder and/or neck portion of bottle shaped containers is achieved by utilizing a shaping die with a generally larger radius than that on the manufactured bottle and if features are desired, such features are provided in the inner surface of the die between the tangent points of the larger radius. This process of reshaping and forming ornamental features in the shoulder is often done in the later stages of necking operations, after the initial shoulder and neck region has been formed.

Changing the shoulder radius can reduce the total surface area of the shoulder radius, therereby causing the metal to compress. As metal compression ensues the container generally is extended in height as permitted by the die and there is excess material available for flowing into recesses in the die without the necessity of an opposing die or mandrel. This flow of metal into the recess area of the die can be utilized to create unique ornamental features on predetermined portions of the shoulder and neck region of the metal container.

In certain embodiments, the shoulder radius of a container is increased and features are added to the shoulder area by making a die with a larger radius than on the manufactured bottle. In certain other embodiments the shoulder radius of the container may be decreased. Desired features are added with relief into the inner surface of the die, preferably between the tangent points of the larger radius. Reshaping and surfaces are formed when the smaller radius shoulder is pressed with force directly into a larger radius die, which may include features and ornamental shapes which are intended to be formed on the shoulder of the container.

The present invention contemplates altering the shape and/or geometry of the shoulder and/or neck region of a bottle shaped metallic container. This may include but is not limited to modifying the shoulder radius of a metallic bottle or can, thereby reducing the total area of the shoulder and causing the metal to compress. As the metal compresses and thickens, the container grows in height and excess metal material becomes available for flowing into recesses in the die with no inner opposing die or mandrel. Increasing the shoulder radius may be done with one or more dies, depending on the final desired ornamental shape. In certain embodiments of the present invention, a container is initially provided with a first shoulder radius. The container is then put into compression as contact is made with the forming tool, wherein the shoulder and/or neck region is reshaped to a larger or smaller radius.

In various embodiments, a device and method of use of the present invention comprises a substantially annular-shaped tool comprising inwardly or outwardly-oriented relief features. Corresponding features are provided in a shoulder portion of the metallic container by shaping the shoulder by an axial movement of the tool which is positioned over the outer circumference of the metallic container. Preferably, the axial movement of the tool on the container is a linear movement wherein the tool and container to be shaped are positioned substantially coaxially, and without the necessity of using any form of internal mandrel or rotating tool. Thus, a shoulder relief shaping process is performed in certain embodiments through the application of a compressive force between an interior of the tool and an exterior of the container. In various embodiments of the present invention the tool remains stationary while the bottle shaped can is moved towards the tool in a substantially linear direction aligned with the longitudinal axis of the container.

Prior art devices provide for inwardly extending features (i.e. indentations) on a metallic container body, and such features are typically formed on a fixed-radius container. In contrast, the present invention provides systems and devices of providing raised features on the shoulder and/or neck region of the bottle shaped container in either a symmetric or asymmetric orientation. Certain embodiments of the present invention comprise die members having surface features that protrude into the die and thus form outwardly protruding features on the shoulder or neck portion of the containers during reshaping. Such features of the present invention may be formed by incrementally increasing the shoulder radius of the container to promote metal movement and outward metal flow in a container-forming operation wherein metal flows outwardly with respect to the container and allows for the creation of outwardly-extending features during a process step that involves placing the container in a state of compression.

Examples of processes and various tools currently used in prior art metal manufacturing processes may be found in U.S. Pat. No. 4,481,163 to Negishi et al., U.S. Pat. No. 5,713,235 to Diekhoff, U.S. Pat. No. 5,718,352 to Diekhoff et al., U.S. Pat. No. 6,094,961 to Aschberger, and U.S. Pat. No. 7,140,223 to Chupak, which are incorporated by reference herein in their entireties.

In various embodiments, a shoulder shaping tool is provided with voids or outwardly oriented relief features for forming desired features on or proximal to a shoulder of a metallic container. The tool is provided as a generally annular device and adapted for substantially parallel movement to the longitudinal axis of the bottle or metal container. The tool may be provided for either symmetric or asymmetric shaping of the container.

In certain embodiments, the present invention comprises a method and apparatus wherein a shoulder forming or shaping tool is devoid of outwardly projecting relief features in a shaping die. For example, in one embodiment, a shaping tool or die is provided without distinct relief features and an internal surface of the tool comprises the shape of an outer surface of a shoulder profile to be formed. The tool is adapted to conduct a forming operation by axial compression of the tool and the container, without rotation of the container or tool and without internal supports or punches provided in the container. Methods and tools of such embodiments provide a fast and efficient method of shaping and reshaping shoulder portions of metal containers.

A method of certain embodiments of the present invention contemplates shaping the shoulder of a container to form various relief features in the shoulder by axial movement of a shaping tool subsequent to the forming of a final shoulder radius. Notably, a shoulder relief shaping process is performed in certain embodiments by utilizing only exterior tool contact or force application. Wherein various prior art methods and devices contemplate blow molding, rotational molding, and/or knockout features for forming, shaping, and reforming a container, the present invention provides for shaping a shoulder portion with a shoulder relief forming tool and in the absence of a mandrel or other similar tools provided on an interior portion of the container. In certain embodiments, an internal static pressure is provided within the container while a shoulder relief forming tool is actuated to form outwardly oriented relief features (i.e. with respect to the container).

In one embodiment of the present invention, a method of reshaping a neck or shoulder portion of a metallic container is providing and comprising reshaping a neck or a shoulder portion of a metallic container, providing a drawn and ironed bottle shaped metallic container with an open upper end, a neck portion, a shoulder portion, a sidewall, and a dome interconnected to a lower end of the sidewall to define a first shape, providing a forming tool having an annular portion sized to engage a portion of at least one of the neck and the shoulder, and wherein an inner surface of the annular portion includes a relief feature, engaging an exterior surface of at least one of the neck portion and the shoulder portion with said forming tool by moving at least one of said forming tool and said bottle shaped metallic container in a substantially linear motion in a direction aligned with the longitudinal axis of said bottle shaped metallic container, and reshaping the metallic container such that at least one of the neck and the shoulder is altered in shape and or dimension and wherein during the reshaping step, a portion of the metallic container moves outwardly away from a common axis of the metallic container and into one or more recesses in the forming tool to modify the first shape of the bottle shaped metallic container.

In another embodiment of the present invention an apparatus for reshaping at least one of a neck and a shoulder portion of a drawn and ironed metallic bottle is provided, comprising an apparatus for reshaping at least one of a neck and a shoulder portion of a drawn and ironed bottle shaped metallic container, the apparatus comprising a forming tool which is oriented in a substantially linear direction with respect to the longitudinal axis of the bottle shaped metallic container, and adapted to engage an exterior surface of at least one of the neck and shoulder portion of the bottle shaped metallic bottle, a central void in said forming tool comprising an inner surface with at least one recess having a predetermined shape, wherein when said forming tool applies a compressive force to at least one of the neck and the shoulder portion, an outwardly-oriented relief feature is formed in the bottle shaped metallic container.

BRIEF DESCRIPTION OF THE DRAWINGS

The accompanying drawings, which are incorporated in and constitute part of the specification, illustrate embodiments of the present disclosure and together with the general description given above and the detailed description of the drawings given below, serve to explain the principle of the present disclosure.

Figure 1:
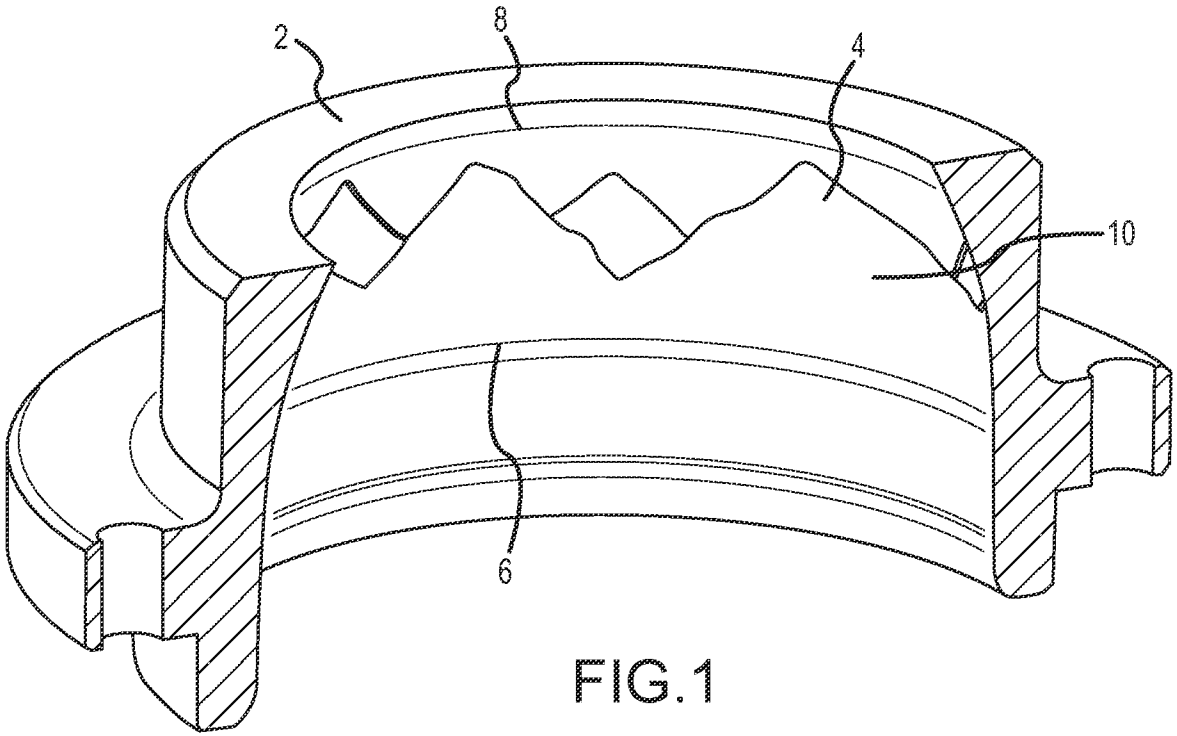
FIG. 1 is a cross-sectional front perspective view of a shaping die according to the present disclosure.

It should be understood that the drawings are not necessarily to scale. In certain instances, details that are not necessary for an understanding of the disclosure or that render other details difficult to perceive may have been omitted from these drawings. It should be understood, of course, that the present disclosure is not limited to the particular embodiments illustrated in the drawings.

DETAILED DESCRIPTION OF THE INVENTION

Various embodiments of the present disclosure are described herein with reference to the drawings. It is expressly understood that although FIGS. 1-7B depict certain embodiments, the present disclosure is not limited to those specific disclosed embodiments.

Referring now to FIG. 1, a compression relief shaping die according to one embodiment of the present invention is shown. The die 2 comprises a generally ring-shaped or annular device wherein a surface of an inner void is adapted to contact a bottle shaped metallic container during forming operations. Contact may occur with either the tool traveling toward a relatively stationary positioned metal container, or alternatively the container traveling toward the substantially stationary tool. In either scenario the tool or container travels in a substantially linear direction which is co-extensive with the longitudinal axis of the metal container. The die 2 comprises raised surface features 4 provided between shoulder radius tangent areas. During forming operations, the metal of the container being formed flows into and at least partially fills these features 4. Upper 6 and lower 8 tangents of the shoulder radius generally comprise upper and lower bounds of the relief area 10 in the depicted embodiment. The embodiment of FIG. 1 comprises a die 2 with a mountain-shaped texture or relief provided in the relief area 10. It will be recognized, however, that the present invention is not limited to any particular shape or relief pattern, and dies can be used with any variety of shapes, indicia, etc.

Embodiments of the present invention comprise providing a metallic container with a large shoulder radius, and a correspondingly larger total area of the shoulder. As the metallic container is necked, metal is compressed and moves outwardly. Upon such movement, the container may be extended in height and excess material flows into recesses or outward protruding features in the die without the necessity of an inner opposing die or mandrel.

Figure 2:
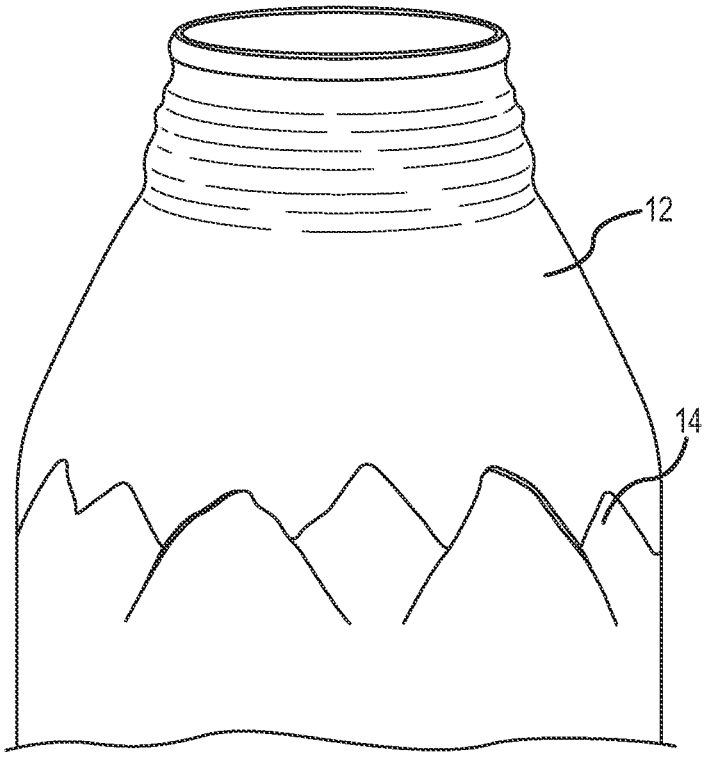
FIG. 2 is a perspective view of a metallic bottle formed by the methods and apparatus described in the present disclosure.

FIG. 2 depicts a container 12 of the present invention formed by a die 2 wherein raised features 14 are provided on the exterior of the container. As shown, the container 12 comprises raised features in the shape of mountain peaks. Such features 14 are created by methods and devices of the present invention as shown and described herein. These features 14 may convey information to a user as indicia and/or provide aesthetic benefits in texturing to a beverage container.

Figure 3:
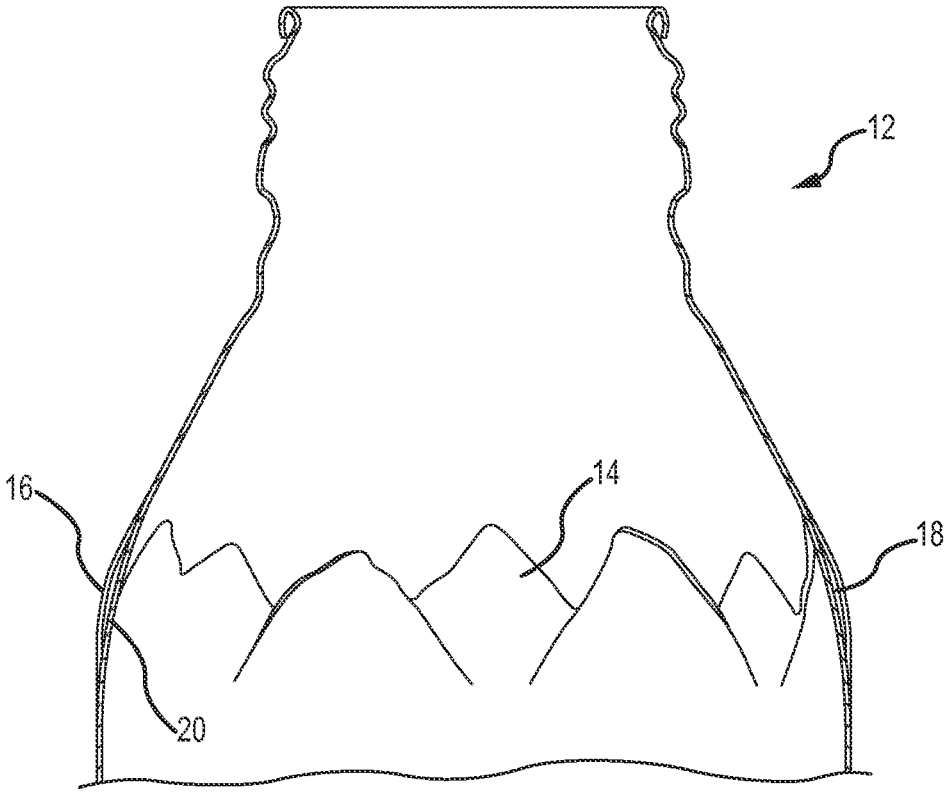
FIG. 3 is a front elevation view of a metallic bottle during formation according to various embodiments of the present invention.

FIG. 3 is a front elevation view illustrating movement of the metal of a metallic bottle 12 during formation. FIG. 3 depicts a container 12 with a first shoulder radius 16 prior to the reshaping operation. During reshaping, the shoulder 16 is compressed and a modified radius 20 shoulder is formed, which may be greater than the first radius. The shoulder 16 may be reshaped by a die as shown and described herein, and relief feature(s) 14 may be formed in the shoulder concurrently with reshaping. It will be recognized, however, that reshaping the shoulder may be performed with or without forming surface features 14. The radius 20 comprises a surface or neck that may be subject to further forming operations, including shoulder relief forming operations as shown and described herein. Thus, the reshaping operation may comprise one operation, or a plurality of shaping steps which gradually modify or alter the shape and/or radius of the shoulder and neck region of the metallic bottle shaped container. The shaping of the shoulder provides an area of reduction 18 corresponding to the movement of the metal during the changing of the shoulder radius.

Figure 4:
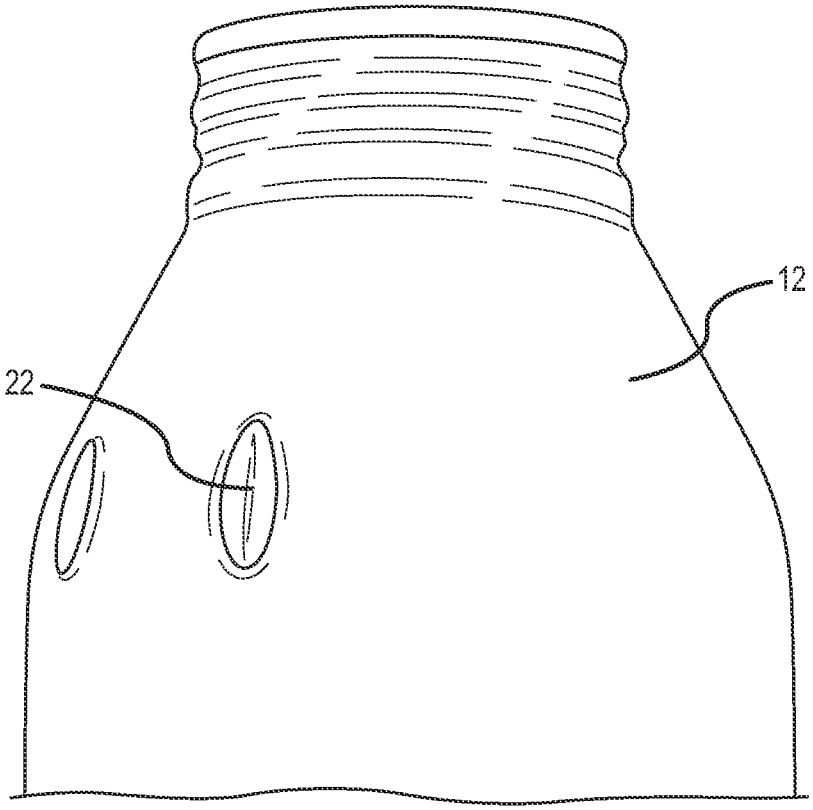
FIG. 4 is a front elevation view of a metallic bottle and depicting various deformities which can form in prior art forming methods.

The compression of the metal during the reshaping operation provides an area of reduction 18 corresponding to the change in shape of the shoulder. Containers having a shoulder radius of up to 2 or 3 inches may be formed using the various methods, tools, and systems of the present invention. In some tests certain containers 12 formed large "puckles" 22 (a buckled pucker) as shown in FIG. 4, with features as small as approximately 0.003" in depth. These puckles 22 result from the extreme compression stress of metal in the area of the shoulder being reshaped, and typically occur when an intermediate step is not performed, i.e., changing the geometry of the shoulder and/or neck region without utilizing an intermediate step. Any change of direction of the metal flow either in or out results in an unstable compressed state of the metal which may result in the occurrence of puckling or other surface abnormalities.

Figure 5B:
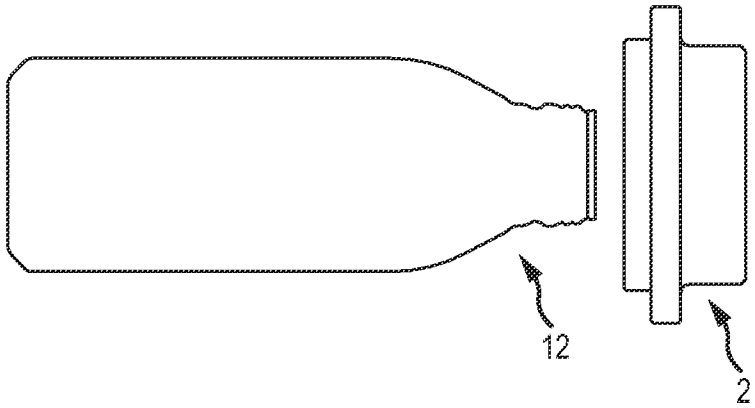
FIG. 5B is a side elevation view of a tool and a container according to one embodiment of the present invention.
Figure 5A:
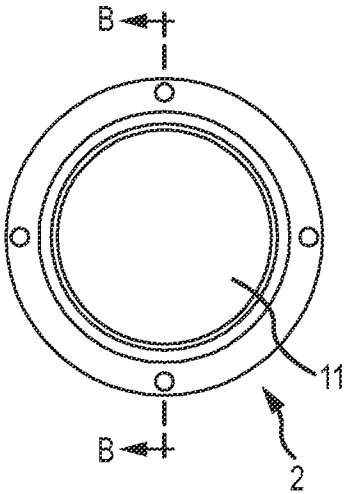
FIG. 5A is a top plan view of a tool according to one embodiment of the present invention.
Figure 5C:
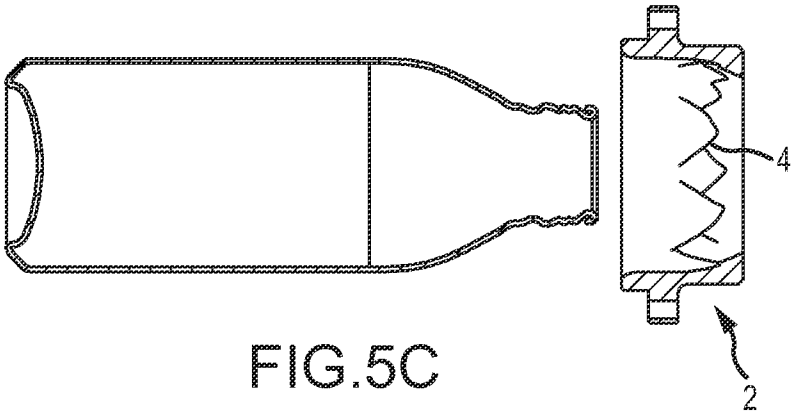
FIG. 5C is a cross-sectional view of a tool and a container according to one embodiment of the present invention.

FIG. 5A is a top elevation view of a shoulder forming tool 2, the tool 2 comprising a generally annular device with a void 11 provided in a central portion. FIG. 5B is a side elevation view of the tool 2 shown in relation to a container 12 to be shaped, just prior to shaping. The depicted container 12 preferable comprises a bottle-shaped can or "can bottle". It will be recognized, however, that features, devices and methods of the present invention are not limited to shaping and forming any particular container. The container 12, at least as shown in FIG. 5B comprises a rounded or smooth shoulder portion that is prepared for shaping. FIG. 5C is a cross-sectional view of FIG. 5B taken about line B-B of FIG. 5A. As shown, the tool 2 comprises internal features 4 for contacting and shaping the shoulder portion of the container 12. The tool 2 of FIG. 5C is depicted prior to having contacted the container 12. As shown in these figures, the shoulder forming with relief features is completed without the use of any tools or dies being positioned within the bottle. The container 12 of FIG. 5C is therefore comprises the original shoulder dimensioning of FIG. 5B.

Figure 6B:
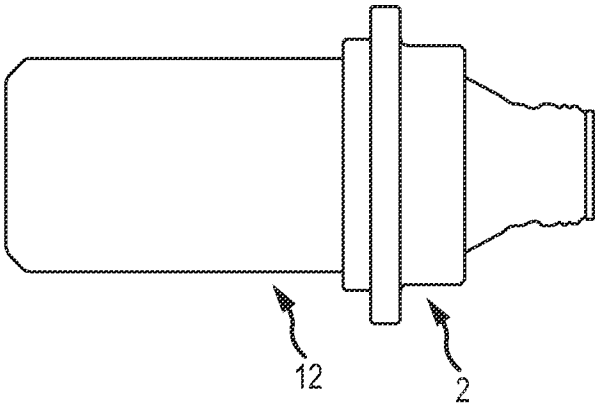
FIG. 6B is a side elevation view of a tool positioned over a neck of metallic bottle according to one embodiment of the present invention.
Figure 6A:
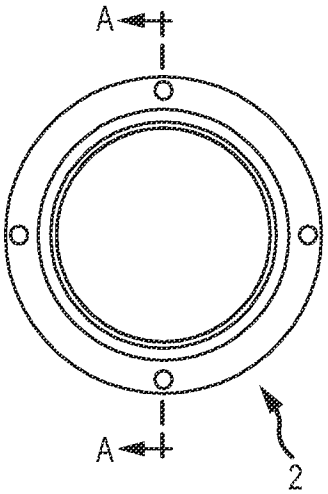
FIG. 6A is a top plan view of a tool according to one embodiment of the present invention.
Figure 6C:
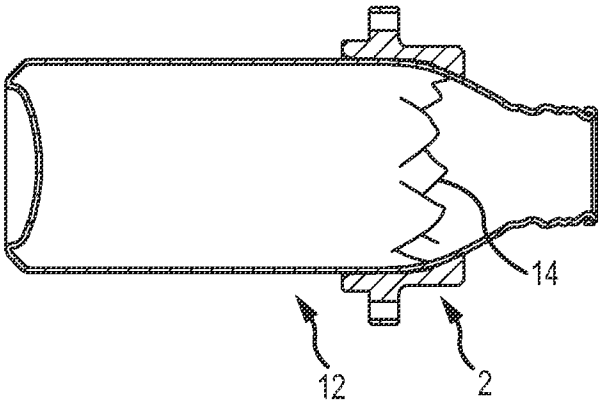
FIG. 6C is a cut-away cross-sectional view of a forming tool positioned over a neck of a metallic bottle according to one embodiment of the present invention.

FIG. 6A is a top elevation view of a shoulder forming tool 2 according to the embodiment of FIG. 5A. FIG. 6B depicts the tool 2 as having been brought into contact with the container 12. FIG. 6C is a cross-sectional view of the tool 2 and container 12 taken along line A-A of FIG. 6A and showing relief features 14 formed on the shoulder of the container 12.

As shown in FIGS. 5A-7B, movement of the tool 2 is substantially parallel to the longitudinal axis of the container 12. Alternatively the tool can be held stationary while the container is moved towards the tool. In preferred embodiments, a container 12 to be shaped is rotationally fixed (i.e. not spinning about a longitudinal axis). Rather, decorative shoulder features are provided by axial movement of the tool 2 and/or container 12. Further, no knock-out tool or tool positioned with the container is provided or required by embodiments of the present invention. In various embodiments, after a neck and shoulder is formed as shown in FIG. 5, one or more tools 2 are provided to reshape the shoulder of the container 12. Containers 12 can be shaped and/or reshaped so as to comprise either a rotational symmetrical or rotationally asymmetrical feature or features on the shoulder area. For example, various embodiments contemplate providing a tool 2 with relief features 4 that are either rotationally symmetric or rotationally asymmetric to form a desired shoulder.

Figure 7A:
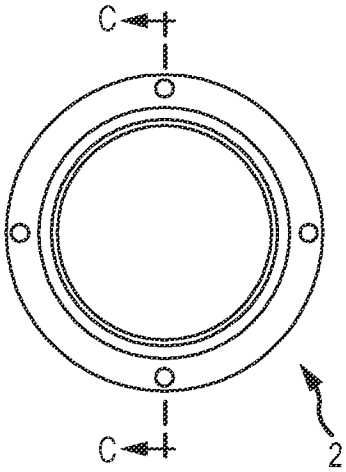
FIG. 7A is a top plan view of a tool according to one embodiment of the present invention.
Figure 7B:
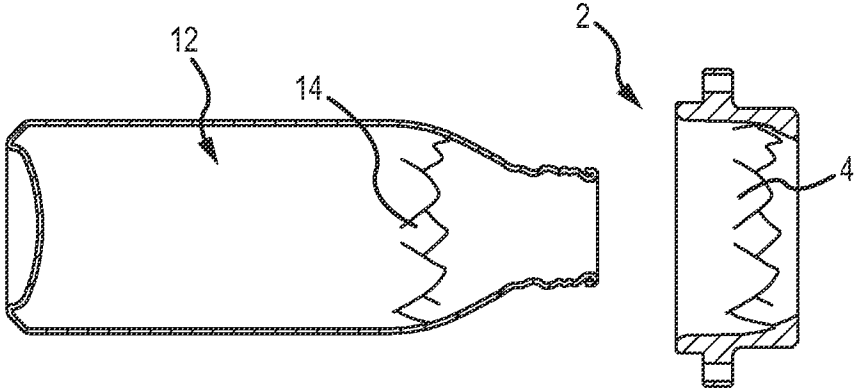
FIG. 7B is a cross-sectional elevation view of a tool after shaping a metallic bottle according to one embodiment of the present invention.

FIG. 7A is a top elevation view of a shoulder forming tool 2 according to the embodiment of FIGS. 5A and 6A. FIG. 7B is a cross-sectional elevation view of the container 12 and tool 2 subsequent to the forming step of FIG. 6C. As shown, the container 12 comprises outwardly oriented relief features 14. In FIG. 7B, the relief features 14 comprise mountain or topography shapes. However, as should be appreciated by one of skill in the art, relief features of the present invention are not limited to any particular shape, indicia or other relief feature 14.

While various embodiments of the present disclosure have been described in detail, it is apparent that modifications and alterations of those embodiments will occur to those skilled in the art. However, it is to be expressly understood that such modifications and alterations are within the scope and spirit of the present disclosure. Further, the invention(s) described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as additional items.

What is claimed is:

1. A method of reshaping a neck or a shoulder portion of a metallic container, the method comprising:

providing a drawn and ironed bottle shaped metallic container with an open upper end, a neck portion, a shoulder portion, a sidewall, and a dome interconnected to a lower end of the sidewall to define a first shape;

providing a forming tool having an annular portion sized to engage a portion of at least one of the neck and the shoulder, and wherein an inner surface of the annular portion includes a relief feature;

engaging an exterior surface of at least one of the neck portion and the shoulder portion with said forming tool by moving at least one of said forming tool and said bottle shaped metallic container in a substantially linear motion in a direction aligned with the longitudinal axis of said bottle shaped metallic container; and reshaping the metallic container such that at least one of the neck and the shoulder is altered in shape and/or dimension; and wherein during the reshaping step, a portion of the metallic container moves outwardly away from a common axis of the metallic container and into one or more recesses in the forming tool to modify the first shape of the bottle shaped metallic container.

2. The method of claim 1, wherein the forming tool comprises a substantially concentric device with a central void.

3. The method of claim 1, wherein the total length of the metallic container is increased after the step of reshaping the container.

4. The method of claim 1, wherein at least one of the shoulder radius and the neck radius is increased in size during said method of reshaping.

5. The method of claim 1, wherein engaging said metallic container creates a compressive force on at least one of said neck and said shoulder.

6. An apparatus for reshaping at least one of a neck and a shoulder portion of a bottle shaped metallic container, the apparatus comprising:

a forming tool which is oriented in a substantially linear direction with respect to the longitudinal axis of the bottle shaped metallic container, and adapted to engage an exterior surface of at least one of the neck and shoulder portion of the bottle shaped metallic bottle;

a central void in said forming tool comprising an inner surface with at least one recess having a predetermined shape, wherein when said forming tool applies a compressive force to at least one of the neck and the shoulder portion, an outwardly-oriented relief feature is formed in the bottle shaped metallic container.

7. The apparatus of claim 6, wherein the at least one recess extends around substantially an entire perimeter of the at least one of the neck and the shoulder portion.

8. The apparatus of claim 6, wherein the radius of at least one of the neck and the shoulder portion are increased during the reshaping of the bottle shaped container.

9. The apparatus of claim 6, wherein the at least one recess extends around less than an entirety of a perimeter of the bottle shaped metal container such that the recess is adapted to form an asymmetric profile in at least one of the neck and the shoulder portion.

* * * * *